US007411353B1

(12) United States Patent
Rutberg et al.

(10) Patent No.: US 7,411,353 B1
(45) Date of Patent: Aug. 12, 2008

(54) ALTERNATING CURRENT MULTI-PHASE PLASMA GAS GENERATOR WITH ANNULAR ELECTRODES

(76) Inventors: Alexander P. Rutberg, 112 Anita Dr., Madison, AL (US) 35757; Philip G. Rutberg, Viboroskoc shose 7-1-25, Saint Petersburg (RU) 194356; Alexei A. Safronov, Dibunovskayo 37-469, Saint-Petersburg (RU) 197183; Vasily N. Shiryaev, Choshimina Str. 13-1-165, Saint-Petersburg (RU) 194356

( * ) Notice: Subject to any disclaimer, the term of this patent is extended or adjusted under 35 U.S.C. 154(b) by 0 days.

(21) Appl. No.: 11/803,052

(22) Filed: May 11, 2007

(51) Int. Cl.
*H05B 31/26* (2006.01)

(52) U.S. Cl. ..... 315/111.21; 427/569

(58) Field of Classification Search ..... 315/111.21, 315/111.31; 427/457, 569, 421.1, 427.3; 219/121.36, 121.39, 121.4, 121.47, 121.48, 219/121.5, 121.51, 121.52
See application file for complete search history.

(56) References Cited

U.S. PATENT DOCUMENTS 3,140,421 A 7/1964 Spongberg
3,798,408 A * 3/1974 Foex et al. ..... 219/121.59
3,953,705 A 4/1976 Painter
4,013,867 A * 3/1977 Fey ..... 219/121.36
4,982,067 A * 1/1991 Marantz et al. ..... 219/121.47
5,144,110 A * 9/1992 Marantz et al. ..... 219/121.48
5,451,739 A * 9/1995 Nemchinsky et al. .. 219/121.51
5,801,489 A * 9/1998 Chism et al. ..... 315/111.21
6,781,087 B1 * 8/2004 Chism et al. ..... 219/121.48

* cited by examiner

*Primary Examiner*—Thuy Vinh Tran
(74) *Attorney, Agent, or Firm*—File-EE-Patents.com; Jay A. Chesavage

(57) ABSTRACT

A plasma generator for three phase mains alternating current operation has three plasma generation tubes interconnected with a nozzle, each plasma generation tube having a plasma initiator for forming a plasma into an electrode ring, the electrode ring including substantially tangential gas introduction orifices which cause gas entering the electrode ring to helically rotate. Each of the electrode rings is coupled to a unique one of the three phases of AC voltage supply, such that when the initiator plasma is introduced into one of the electrode rings, a plasma discharge occurs with a path from the electrode ring, through the plasma generation tube, and to a different electrode ring. Each electrode ring has gas introduced in a helically rotating manner such that the erosion of the surface of the electrode ring is uniform over the entire surface, and minimally erosive in a single arc attachment spot, since the arc spot is constantly moving as provided by the helical trajectory of the gas entering the electrode.

22 Claims, 7 Drawing Sheets

3 Phase Plasma Generator

Plasma Outlet Projection View

Section A–A of Fig 2

Initiator and Annular Electrode

Section B–B & D–D of Fig 4

Section C–C of Fig. 4

ALTERNATING CURRENT MULTI-PHASE PLASMA GAS GENERATOR WITH ANNULAR ELECTRODES

FIELD OF THE INVENTION

The present invention relates to the field of plasma gas generators, and particularly plasma gas generators continuously producing a source of plasma and operating on polyphase mains alternating current (AC).

BACKGROUND OF THE INVENTION

Plasma generators form high energy plasma gas, which is then used for a variety of application, including plasma-jet cutting, coatings, hard-facing, vitrification of radioactive materials, disinfection of waste, and many other applications. Industrial plasma generation systems may consume large amounts of power on the order of mega-watts (MW), and for these systems, it is desired that the plasma generator be simple and reliable. One problem of particular interest in high power plasma generation systems is extending the life of the electrode at the plasma-conductive interface. The plasma attachment region, known as the arc spot, of the electrode may preferentially erode compared to the other regions of the electrode, resulting in premature replacement of the electrode. In general, it is desired to have an electrode with large exposed surface area that is suitable for some form of liquid cooling.

PATENT PRIOR ART

U.S. Pat. No. 5,801,489 describes a plasma generator operating directly from three phase mains power and utilizing an ionized gas which is introduced proximal to electrodes connected to the three phases of main power, thereby forming plasma between the electrodes. The electrodes achieve distributed wear patterns because the plasma self-induced magnetic field, also known as the rail gun effect, causes the plasma arc to move along the electrode from a position of short arc length to a position of long arc length. While this results in a uniform electrode wear on the working area of the electrode, one disadvantage is that the end to end plasma arc length varies by more than a ratio of 3:1 from initiation to termination. It is desired to have a plasma arc which is of comparatively constant length and density. Another problem of this system is that as the plasma arc travels down the extent tubular electrode, radial variations in the arc spot may be minimal, leading to path erosion along the electrode which may be worn excessively in a single path compared to other regions.

U.S. Pat. No. 3,140,421 describes a polyphase plasma generator having linearly arranged electrodes, whereby a plasma is formed between two adjacent electrodes and swept down a plasma tube to an exit aperture. The generator has no provision for uniform electrode wear.

U.S. Pat. No. 3,953,705 describes a plasma generator for operation with direct current, where the plasma generator has a sequential series of plasma cavities, each with a plasma entrance and exit, with air introduced in each cavity and having a circumferential velocity to prevent the plasma from eroding the plasma channel as it is transported from one electrode to another.

U.S. Pat. No. 4,013,867 describes a plasma generator for three phase power, where the generator has a plurality of plasma tubes connected with a common chamber, whereby the plasma initially forms across an annular gap, after which a plasma gas is introduced in the gap and travels down the plasma tubes. The plasma is centered in each plasma tube using an effect of an external magnetic field source, shown as a solenoidal coil.

OBJECTS OF THE INVENTION

A first object of the invention is a plasma generator suitable for coupling to polyphase mains power and operating at the mains line frequency, where the plasma generator has a plurality of plasma sources interconnected through a plasma nozzle, each plasma source having a plasma initiator which couples plasma into the area of an annular electrode which is coupled to one of the phases of the mains power, and the annular electrode is separated from the nozzle by a plasma channel.

A second object of the invention is a uniform wear annular electrode centered on an axis and having an extent, the annular electrode for use in a plasma generator accepting a gas for forming a plasma, the plasma forming an arc spot on the annular electrode, the annular electrode having a plurality of apertures positioned to form circumferential gas flow over the extent of the annular electrode, and also beyond the extent of the annular electrode, such that the introduction of the plasma gas causes the arc spot to rotate circumferentially about the electrode, and also over the extent of the electrode.

A third object of the invention is an annular electrode for use in a plasma generator, the plasma having an arc spot on the surface of the annular electrode, the annular electrode also having a plurality of gas introduction ports over the extent of the annular electrode, at least one of which is adjacent to a first end of the annular electrode, and another which is adjacent to a second end of the annular electrode and opposite the first end, such that by controlling flow or pressure to first end or second end, the plasma arc spot may rotated circumferentially, and also varied continuously from the first end to the second end.

A fourth object of the invention is a plasma generator having a plurality of annular electrodes, each annular electrode coupled to a mains voltage phase at a mains frequency, the annular electrode having an axis which defines an extent of the annular electrode, and an annular electrode inner surface which includes apertures for the introduction of gas and circulation of the gas and a plasma formed from the gas in a circumferential direction about the axis, and also varying over the extent of the annular electrode, such that the plasma location may be temporally varied circumferentially and over the extent of the electrode to cause uniform arc spot electrode erosion over time.

SUMMARY OF THE INVENTION

A plasma generator has three elongate plasma sources connected together by a nozzle. Each elongate plasma source has an initiator end for generating an initial plasma, an annular electrode having an inner surface into which the initial plasma may form, both of which are positioned about a plasma source axis, the electrode having and a plurality of tangential gas introduction apertures for causing a formed plasma to rotate circumferentially and axially after formation. The annular electrode is followed by a plasma channel coupled to the nozzle, such that when the initiators of each plasma source is ionizing the gas, each of the three annular electrodes are excited by an electrical voltage that is substantially 120 degrees out of phase with any other electrode, thereby resulting in the formation of a plasma from one annular electrode, through the plasma channel to the nozzle, thereafter through a different plasma channel and to the related annular electrode. Through the introduction of the gas using circumferential apertures, the plasma arc attachment to the annular electrode rotates from the applied force of the introduced gas, thereby preventing spot wear on the annular electrode.

DETAILED DESCRIPTION OF THE INVENTION

Figure 1:
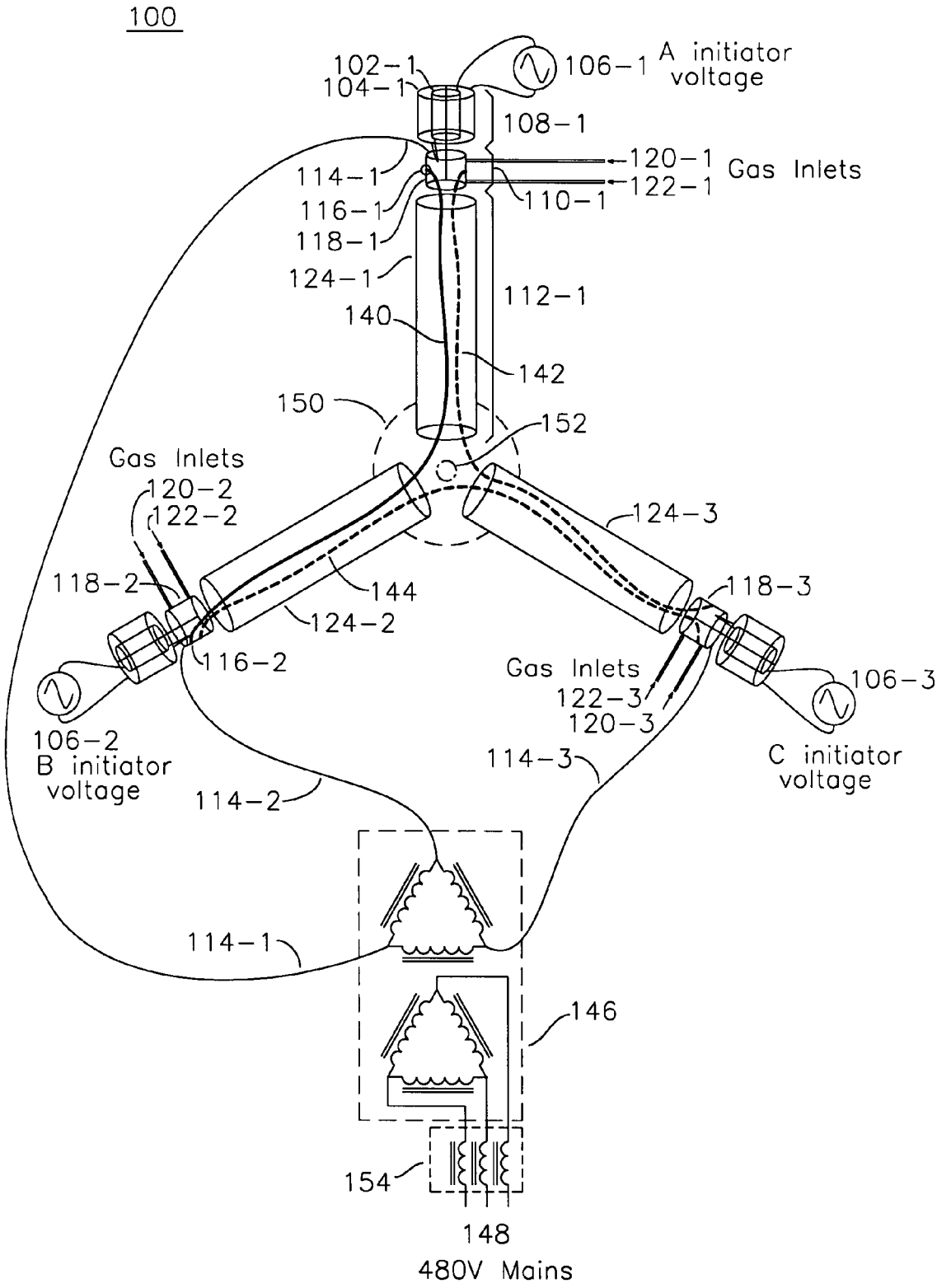
FIG. 1 shows a simplified projection view of the plasma generator.

FIG. 1 shows a simplified projection view of a plasma generator 100, which comprises nozzle 150 having exit aperture 152 for the emission of plasma formed in a plurality of plasma tubes 124-1, 124-2, and 124-3. The individual elements are shown in an exploded view, however the plasma generator is a closed system whereby native gas enters at inlets 120-1, 122-1, etc., for each plasma source, and exits as a fully formed plasma at nozzle exit aperture 152. Each plasma tube such as 124-1 has an inner plasma channel for the passage of plasma through a plasma forming extent 112-1 with one end of the plasma channel attached to nozzle 150 and the other end attached to annular electrode 118-1, which in turn is coupled to one phase of the secondary winding of three phase transformer 146. The annular electrode 118-1 has an inner surface, optionally with a diameter in the range of 30 mm to 300 mm, and the region where a plasma interacts with the annular electrode inner surface is known as a plasma arc spot 116-1. In device use, the high current density combined with the high plasma temperature causes erosion of the annular electrode 118-1 if the arc spot 116-1 is stationary. The erosion may be controlled and electrode temperature reduced if the arc attachment spot 116-1 moves over the inner conductor surface circumferentially and over the extent of the electrode along the center axis, where the electrode extent may optionally be in the range 30 mm-300 mm. The circumferential movement is generated by the introduction of gas through apertures in the annular electrode, where the apertures are tangential to a circle having a center on the electrode axis and a radius less than the inner surface of the annular electrode, as will be described later. Additionally, gas inlets 120-1 and 122-1 are located at opposite extents of the annular electrode, and the gas inlets are separately controllable, such that in addition to the circumferential movement of the arc spot on the surface of the electrode, the arc spot may be moved axially along the extent of the electrode, thereby distributing the energy of the arc spot over a comparatively large electrode surface in a controllable manner. Additionally, the circumferential movement of the introduced gas over the electrode surface provides a cooling effect which reduces the surface temperature of the annular electrode. Adjacent to the annular electrode 118-1 is a plasma initiator 108-1 for forming an initial plasma near the inner surface of the annular electrode 118-1. In one embodiment of the invention, the plasma initiator 108-1 has an inner electrode 102-1 and an outer electrode 104-1 driven by an initiator voltage 106-1, which may be a continuous high frequency voltage sufficient to maintain a continuous source of initiation plasma, where the initiation plasma has an electron density $n_e$ from $10^{12}/cm^3$ to $10^{14}/cm^3$. The construction of other plasma tubes 124-2 and 124-3, as well as annular electrodes 118-2 and 118-3 with gas inlets 120-2, 122-2, 120-3, and 122-3, and plasma initiators related to each electrode are substantially as described for the first plasma tube 124-1.

Each electrode 118-1, 118-2, 118-3 is driven by a different phase of three phase transformer 146, which may be at a voltage in the range of 400 to 10,000 volts RMS (root mean squared) and at the frequency of the mains voltage 148. Transformer 146 is shown as a three phase delta-delta transformer, although it could be a wye-delta, or any combination, as is known in the prior art of three phase power. As the applied voltage is a sinusoidal alternating current voltage, the plasma that is formed is making and breaking in each plasma tube at the line voltage frequency. Also, the plasma initiation voltage to cause breakdown is lower than the voltage required to maintain the plasma. For these two reasons, it is useful to provide some sort of current limiting impedance for each electrode to limit the plasma current and thereby establish the current density of the plasma, and this function is performed by current limiter 154, shown as series inductors applied on each branch of transformer 146, although it is also possible to place the current limiters on the individual leads on the secondary of the output transformer 146 where the currents may be lower but operating voltage higher. The current limiting inductors 154 may also include adjustable taps so that the current limit may be set manually or automatically.

Figure 2:
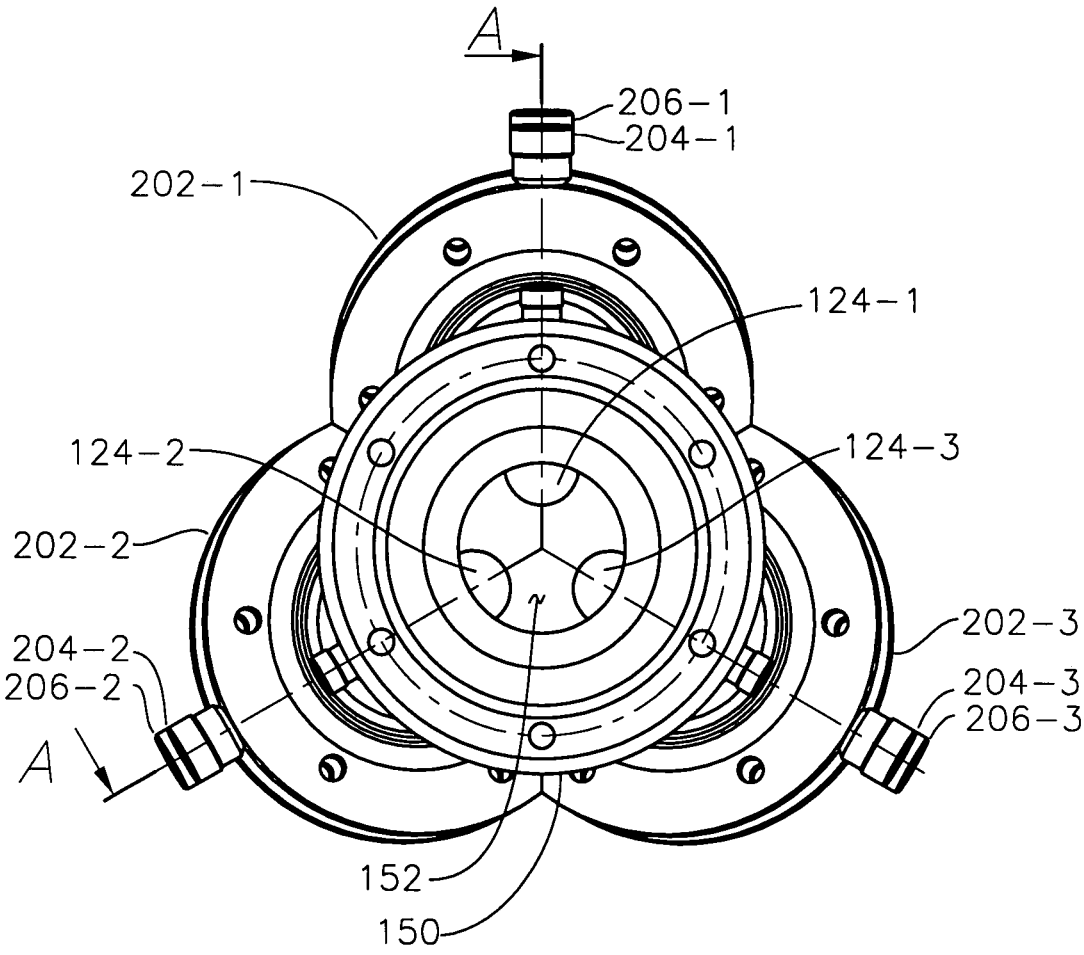
FIG. 2 shows a projection view of the plasma generator from the nozzle end.

FIG. 2 shows the projection view from the plasma nozzle 150 exit aperture 152, including the plasma tubes 124-1, 124-2, and 124-3. Annular electrode housings 202-1, 202-2, and 202-3 and associated gas inlets 204-1, 206-1, 204-2, 206-2, 204-3, and 206-3 are also shown, and these structures may be seen in section view from angular section A-A of FIG. 2, which is shown in FIG. 3.

Figure 3:
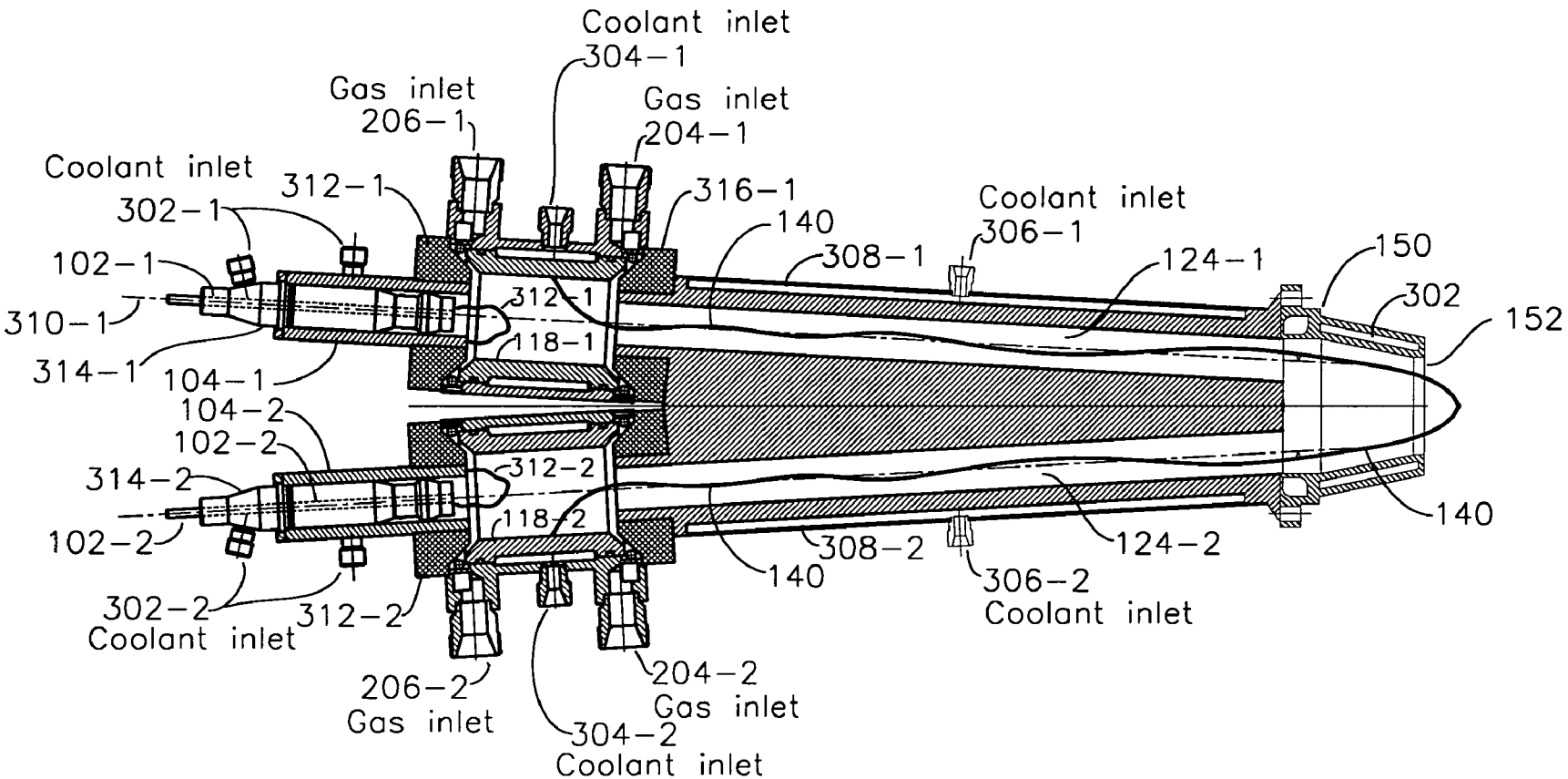
FIG. 3 shows angled section A-A of the plasma generator of FIG. 2.

FIG. 3 shows the angled section view A-A through FIG. 2, and includes two of the plasma tubes 124-1 and 124-2 and related structures, which are each placed symmetrically about respective electrode axis 310-1 and 310-2. Nozzle 150 has cooling fluid passage 302, exit aperture 152 and a nozzle mixing chamber which is common to plasma tubes 124-1 and 124-2, which also have related liquid cooling jackets 308-1 and 380-2 with respective coolant inlets 306-1 and 306-2, as well as coolant exhaust ports (not shown). Examining a single plasma tube, electrode, and related structure, plasma tube 124-1 and annular electrode 118-1 are cylindrical and positioned about electrode axis 310-1, and the annular electrode 118-1 includes rear plasma gas inlet 206-1 and front plasma gas inlet 204-1, where the structure of electrode 118-1 causes the plasma gas to be introduced into the annular electrode with a flow tangential to a circle having a center on the axis 310-1 and a radius within the electrode 118-1 inner surface, as will be seen in other views. The apertures in the annular electrode which introduce the plasma gas may be in the range of 0.5 mm to 2 mm, or any diameter required to generate circumferential gas rotation inside the annular electrode. Adjacent to the annular electrode 118-1 is the plasma initiator, which comprises outer electrode 104-1, inner electrode 102-1, and an annular insulator 314-1 positioned between them. When a plasma initiation voltage is provided between the inner electrode 102-1 and outer electrode 104-1, an initiating plasma arc 312-1 is formed which enters the extent of annular electrode 118-1. The structures of second plasma tube 124-2, electrode 118-2, and initiator formed by outer electrode 104-2, inner electrode 102-2 with annular insulator 314-2 cause plasma arc 312-2 to form in the other annular electrode 118-2, resulting in the formation of primary plasma arc 140 from one annular electrode 118-1 to another annular electrode 118-2. Isolators 312-1 and 312-2 isolate the initiator structures from the conductive electrodes 118-1 and 118-2, and isolators 316-1 and 316-2 isolate the annular electrode 118-1 and 118-2 from the structures surrounding plasma tubes 124-1 and 124-2. Additionally, cooling ports 302-1 allow for the flow of coolant through the plasma initiators, which typically require on the order of 0.1% of the main plasma power developed from one annular electrode such as 118-1 to another such as 118-2. The bulk of the cooling requirements are handled by electrode coolant ports 304-1 and 304-2 and plasma tube coolant ports 306-1 and 306-2 as shown.

Figure 4:
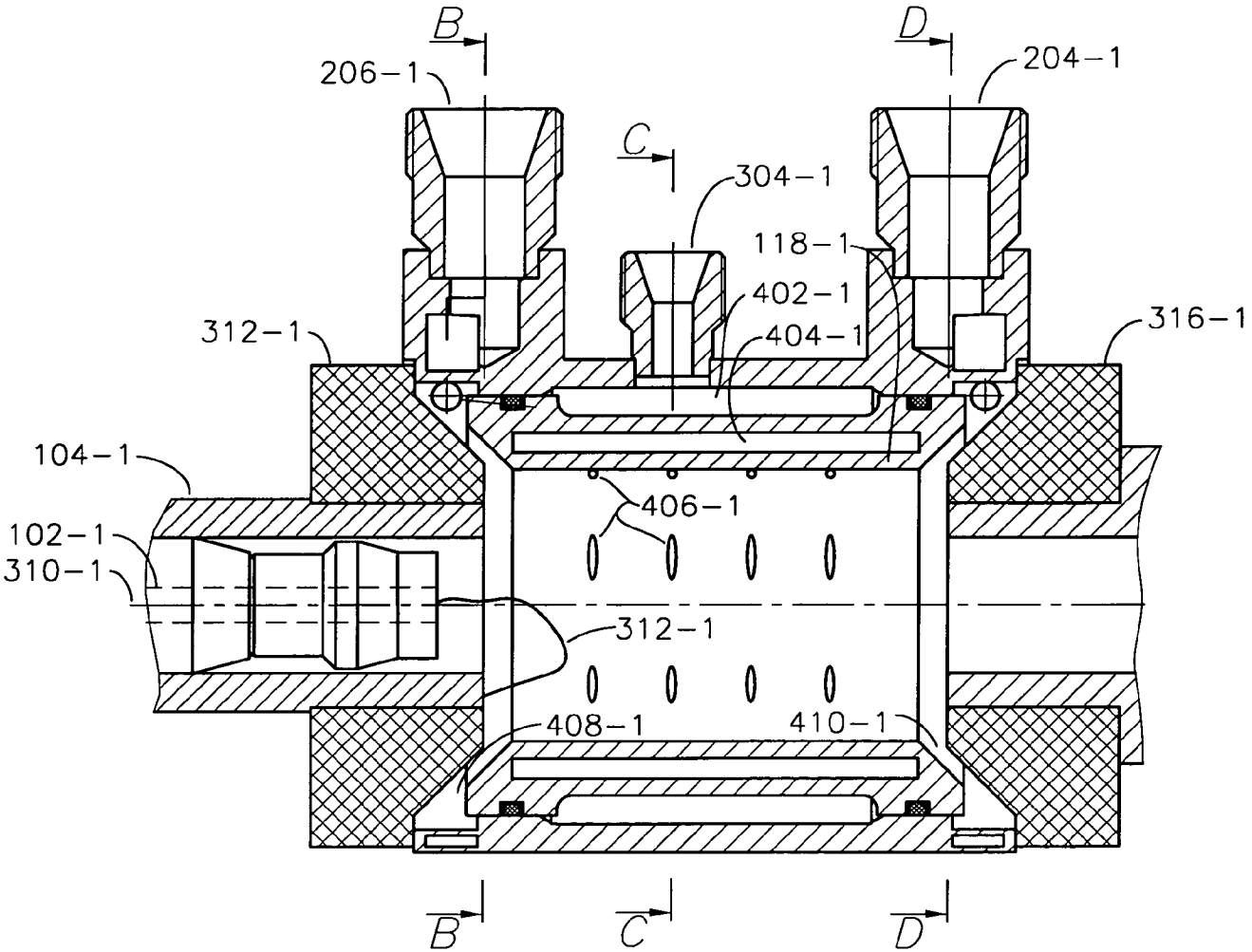
FIG. 4 shows the plasma arc initiator and annular electrode.

FIG. 4 shows a detailed section view of the initiator and annular electrode for a single plasma tube, including inner electrode 102-1, outer electrode 104-1, and initiator plasma arc 312-1 which is formed between the inner and outer initiator electrodes and into the extent of annular electrode 118-1. The annular electrode 118-1 also has coolant port 304-1 coupled to coolant passage 402-1 for removing heat formed in the annular electrode. The annular electrode 118-1 also has plasma gas apertures 406-1 as well as front circumferential gas passage 410-1 and rear circumferential gas passage 408-1.

Figure 5:
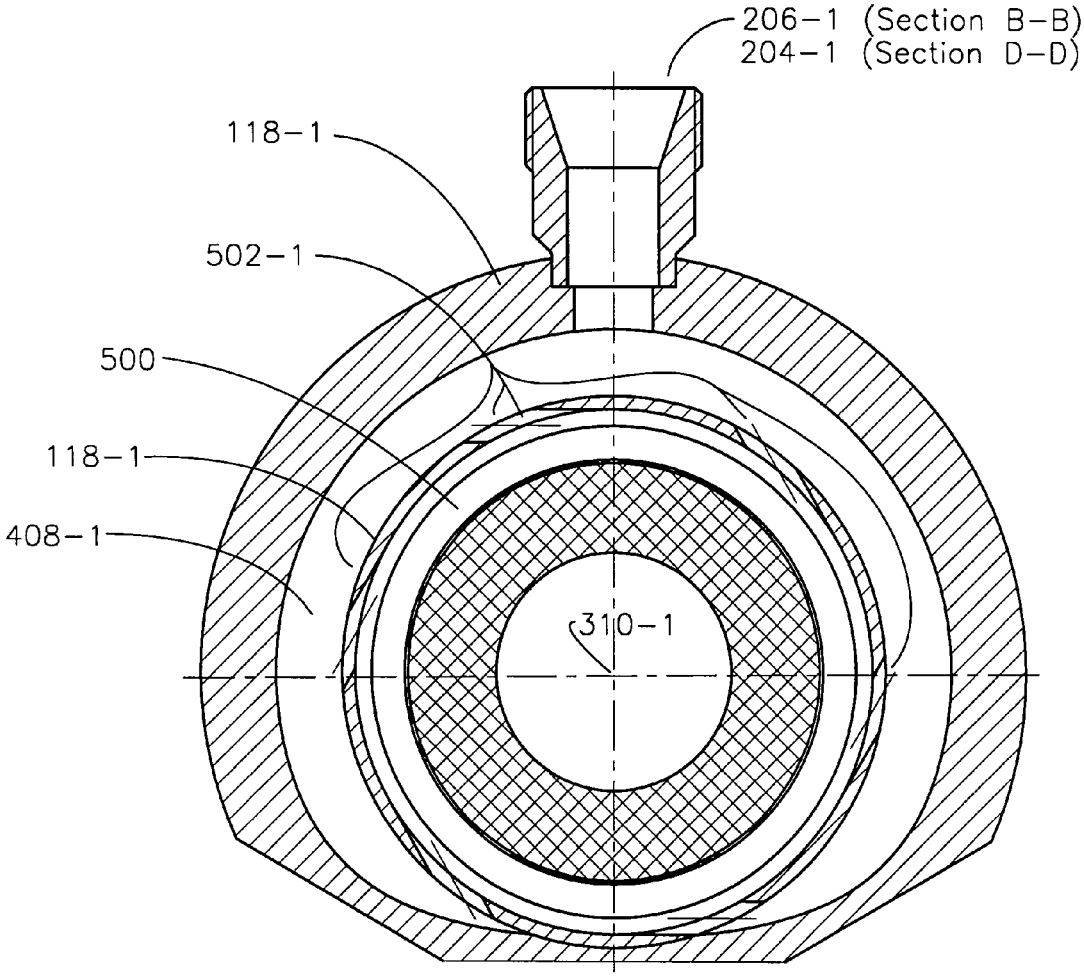
FIG. 5 shows section B-B and section D-D of FIG. 4.
Figure 6:
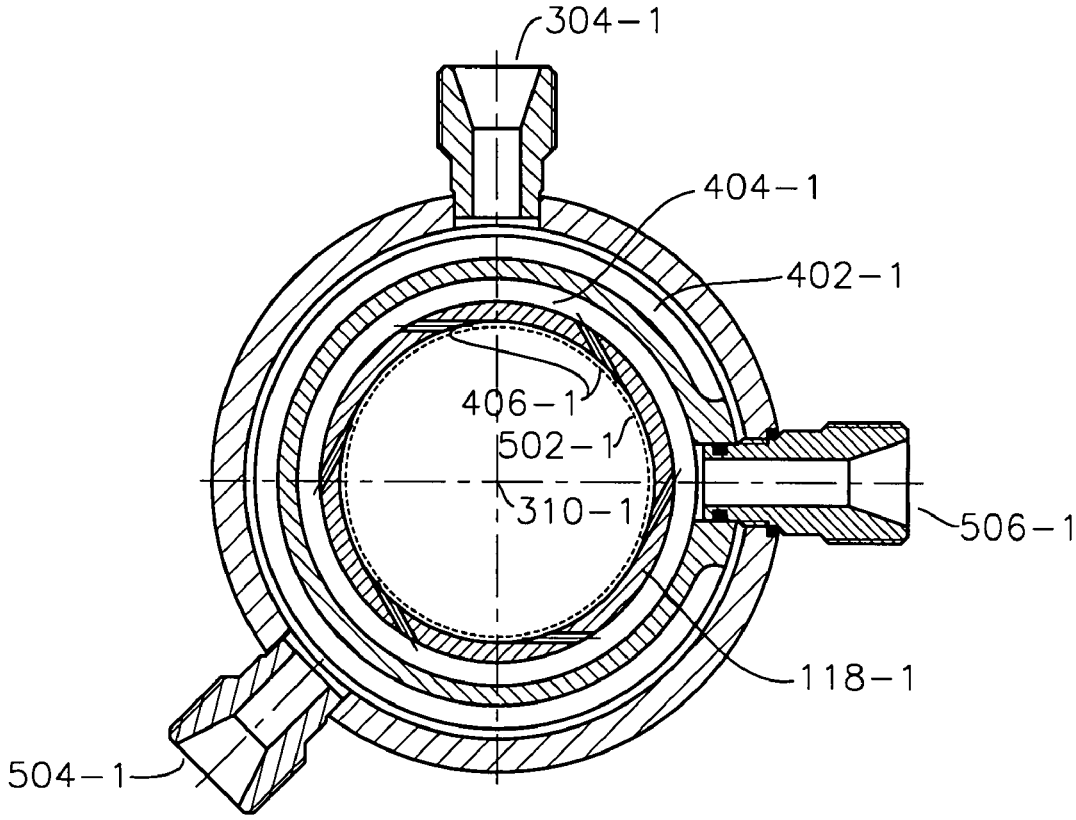
FIG. 6 shows section C-C of FIG. 4.

FIG. 5 shows a shared cross section view for B-B and D-D of FIG. 4, with both views perpendicular to the center axis 310-1, showing the circumferential gas passages 502-1. The circumferential apertures 502-1 cause the gas entering port 206-1 (for section B-B) and port 204-1 (for section D-D) to swirl in the same direction at both ends and also in the middle of the electrode as shown in FIG. 6. Although shown in the example as clockwise circumferential movement, the particular direction of rotation is unimportant. The swirling plasma gas causes the arc spot which tends to start near the initiator and attach to an adjacent point of the electrode to be swept circumferentially around the center axis 310-1 and down the extent of the annular electrode along axis 310-1. In the best mode of the invention, the gas pressures at ports 206-1 and 204-1 are controlled such that the plasma initiation and helical arc movement occurs through the entire electrode extent over a single plasma arc formation and extinguishment cycle, which is derived from the mains AC frequency.

FIG. 6 shows annular electrode in section view C-C of FIG. 4, and includes the plasma gas port 506-1, which couples the gas through port 404-1 and into the annular electrode 118-1 via circumferential apertures 406-1, which may be tangent to reference circle 502-1 which has a center on the central axis 310-1 and a radius which is less than the inner radius of electrode 118-1. Cooling ports 304-1 and 504-1 couple cooling fluid to cooling jacket 402-1.

Figure 7:
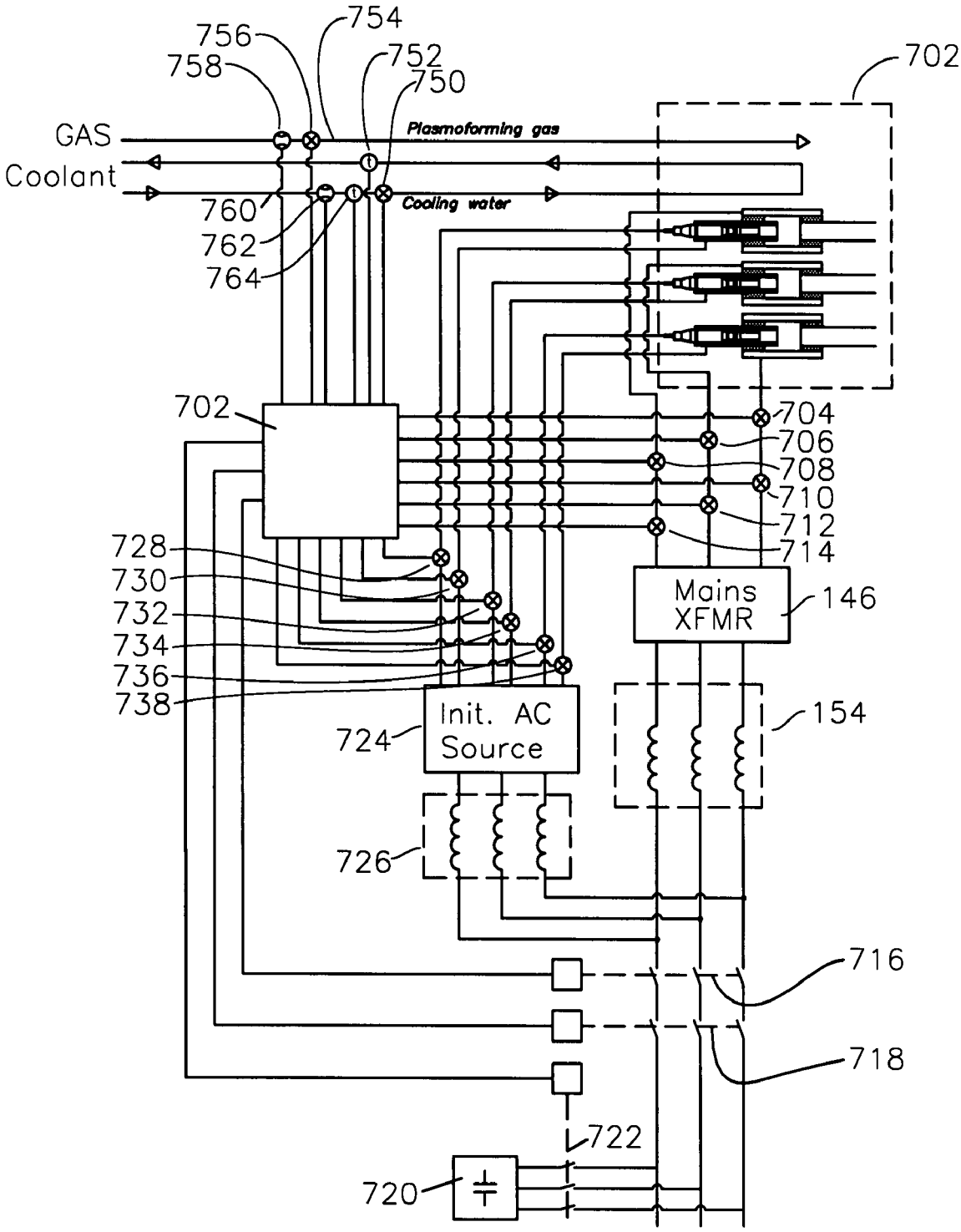
FIG. 7 shows a control system for the plasma generator.

FIG. 7 shows the system operational diagram for all of the components of the plasma generation system. The plasma initiators of plasma generation system 100 are powered by system controller 702, which also measures the applied voltages via voltage sensors 710, 712, 714 and current sensors 704, 706, 708 from the output of transformer 146, as current limited by limiter 154. The application of mains voltage to the current limiter 154 and transformer 146 is controlled by first contactor 706 and second contactor 718, which are also controlled by controller 702. The use of inductors to limit current results in a strong power factor shift, which is compensated by capacitor bank 720, which serves to add capacitive reactive current to the mains current flow to offset the inductive reactive current of the current limiter 154. The low voltage initiators fed by injector power supply 724 are current limited by initiator current limit inductor 726 for the case where the source 724 is an AC transformer coupled to the mains, or alternatively it may not be required if source 724 is a continuous HF source. The initiator voltages are sensed by sensors 728, 732, and 736, while the related currents are read by current sensors 730, 734, 738. The other inputs read by the controller 702 include coolant flow 762, temperature 752, and gas inlet flow sensor 758. Coolant valve 750 and gas valve 756 turn the respective flows on and off as part of the operational sequence. There are many safety interlocks and the like which may be practiced in the present invention. One sequence of operation is as follows:

1) Verify inlet coolant temperature and flow (open valve 750, measure temperature 764);

2) Upon satisfactory coolant temperature and verified flow, open gas valve 756 and regulate pressure 758;

3) Apply voltage to plasma initiators via supply 724, measure and control initiator voltages (728, 732, 736) and currents (730, 734, 738) applied to injectors;

4) Apply secondary voltages to annular electrodes via contactors 716, 718

5) control cooling water and gas flows during plasma production

6) Orderly shutdown: remove annular electrode power, remove gas flow, remove plasma initiator power, wait for plasma areas to cool down, remove water flow.

There are many variations of the present invention which may be practiced, and the particular variations mentioned herein are for illustration only, and are not intended to limit the invention.

The plasma gasses which may be introduced into the annular electrode apertures and ports include individually or in combination: air, carbon dioxide ($CO_2$), carbon monoxide (CO), chlorine gas (Cl), Fluorine (F), Nitrogen ($N_2$), Argon (Ar), Helium (He), Hydrogen gas ($H_2$), and their related compounds, and water vapor.

The annular electrode may be formed from any of the following metals individually or in combination: alloys of iron (Fe) and/or copper (Cu) optionally with additives of rare earth metals, or Tungsten (W) optionally with any of the rare earth metals, including Lanthanum (La), Thorium (Th), or Yttrium (Y).

The current limiting function provided by inductor 154 of FIG. 1 and FIG. 7 may include separate inductors placed in series with each transformer primary or secondary winding, or it may comprise any alternate means for limiting current to the plasma arc, including transformer windings which are loosely coupled to the core, and have a self inductance which is suitable to limit current to the desired level, or alternatively the current limiter may comprise a ballast resistance, although inductive throttles are preferred as they provide instant reaction to plasma instability.

The circumferential plasma gas introduction on the inner surfaces of the annular electrode may be accomplished via apertures in the size range 0.1 mm to 0.2 mm, or any range larger or smaller than this. The apertures can have central bores which are tangential to a circle inside the inner radius of the annular electrode, or they may comprise any arrangement of apertures which cause circumferential force to be applied to the plasma arc spot. Additionally, the plasma initiation may be accomplished by an electrical arc triggered initiation, as shown in FIG. 4, or it may be a continuous supply of plasma furnished to the region of the annular electrode, or any other means known in the prior art.

While the invention is shown for three phases, the invention may be practiced without upper or lower limit to the number of phases or angular separation by having the number of plasma tubes with associated annular electrode equals the number of phases, and connecting each plasma tube to a unique electrode.

We claim:

1. A plasma generator having:

a nozzle;

a plasma gas;

a plurality of annular electrodes, each annular electrode having an axis and an inner surface, each said annular electrode separated from said nozzle by a plasma channel;

each said annular electrode having a source of initiated plasma, each said annular electrode having a plurality of apertures located on said inner surface, at least one said aperture positioned substantially tangent to a circle located between said inner surface and said axis, said apertures coupled to said plasma gas;

said annular electrode also having a first plasma gas introduction region on an end furthest to said nozzle and a second plasma gas introduction region closest to said nozzle, said first plasma gas introduction region and said second plasma gas introduction region coupled to said plasma gas;

said annular electrode apertures and said first and second plasma gas introduction regions causing a plasma forming on said annular electrode inner surface to rotate circumferentially and also to move from said electrode nozzle near end to said nozzle far end.

2. The plasma generator of claim 1 where said plurality of annular electrodes is three, and each said annular electrode is coupled to a mains phase.

3. The plasma generator of claim 1 where said plasma gas includes at least one of air, carbon dioxide, carbon monoxide, chlorine gas, Fluorine gas, Nitrogen, Argon, Helium, Hydrogen gas, and water vapor.

4. The plasma generator of claim 1 where said inner electrode apertures have a diameter from 30 mm to 100 mm and an extent of 30 mm to 300 mm.

5. The plasma generator of claim 1 where said inner electrode apertures are formed from at least one of the materials Tungsten, alloys of iron (Fe) and/or copper (Cu), optionally with an additives of a rare earth metal.

6. The plasma generator of claim 1 where said nozzle, said annular electrode, and said plasma channel are cooled by a circulating liquid.

7. The plasma generator of claim 1 where said source of initiated plasma is an ionized gas coupled into the extent of said annular electrode opposite said plasma channel, said ionized gas having an electron density $n_e$ from $10^{12}/cm^3$ to $10^{14}/cm^3$.

8. The plasma generator of claim 1 where said source of initiated plasma is a plasma initiator which generates an electric arc through said plasma gas.

9. The plasma generator of claim 1 where said annular electrode apertures locations and the flow of gas through said apertures provide uniform erosion of said inner surface from an arc spot of said plasma.

10. The plasma generator of claim 1 where said annular electrodes are coupled to different phases of an alternating current (AC) voltage source with an RMS voltage in a range of 400 to 10,000 volts.

11. The plasma generator of claim 1 where each said annular electrode is coupled to a separate phase of a mains voltage source through a step-up transformer, the number of phases being at least 3.

12. A plasma generator for a polyphase alternating current power source, the plasma generator having:

a nozzle having an exit aperture and a plurality of input apertures;

a plasma gas;

a plurality of plasma sources, each plasma source coupled to one of said nozzle input apertures;

each said plasma source having:

an annular electrode having an axis and extent and coupled to a unique phase of said polyphase power source, said annular electrode having an inner surface for plasma attachment and a plurality of apertures substantially tangent to a circle having a radius about said electrode axis, said plurality of apertures of said annular electrode coupled to said plasma gas, said annular electrode also having a first plasma gas introduction region and a second plasma gas introduction area on opposite side of said annular electrode extent;

a plasma channel positioned between said annular electrode and said nozzle input aperture;

whereby said plasma gas flow to each of said inner surface, said first, and said second plasma gas introduction regions cause said plasma attachment to move substantially circumferentially about said electrode inner surface and also substantially over said annular electrode extent.

13. The plasma generator of claim 12 where said plurality of annular electrodes is three, and each said annular electrode is coupled to a mains phase.

14. The plasma generator of claim 12 where said plasma gas includes at least one of air, carbon dioxide, carbon monoxide, chlorine gas, Fluorine, Nitrogen, Argon, Helium, Hydrogen gas, and water vapor.

15. The plasma generator of claim 12 where said inner surface of said annular electrode forming a diameter from 30 mm to 100 mm and an extent of 30 mm to 300 mm.

16. The plasma generator of claim 12 where said inner surface of said annular electrode formed from at least one of the materials Tungsten, alloys of iron (Fe) and/or copper (Cu), optionally with an additives of a rare earth metal.

17. The plasma generator of claim 12 where said nozzle, said annular electrode, and said plasma channel are cooled by a circulating liquid.

18. The plasma generator of claim 12 where said annular electrode further comprising a source of initiated plasma which is an ionized gas coupled into the extent of said annular electrode opposite said plasma channel, said ionized gas having an electron density $n_e$ from $10^{12}/cm^3$ to $10^{14}/cm^3$.

19. The plasma generator of claim 12 where said annular electrode further comprising a source of initiated plasma which is a plasma initiator which generates an electric arc through said plasma gas.

20. The plasma generator of claim 12 where said annular electrode apertures locations and the flow of gas through said apertures provide uniform erosion of said inner surface from an arc spot of said plasma.

21. The plasma generator of claim 12 where said annular electrodes are coupled to different phases of an alternating current (AC) voltage source with an RMS voltage in a range of 400 to 10000 volts.

22. The plasma generator of claim 12 where each said annular electrode is coupled to a separate phase of a mains voltage source through a step-up transformer, the number of phases being at least 3.

* * * * *

UNITED STATES PATENT AND TRADEMARK OFFICE

CERTIFICATE OF CORRECTION

PATENT NO. : 7,411,353 B1
APPLICATION NO. : 11/803052
DATED : August 12, 2008
INVENTOR(S) : Alexander P. Rutberg et al.

It is certified that error appears in the above-identified patent and that said Letters Patent is hereby corrected as shown below:

Column 4, line 44 "and 380-2 with" should be changed to --and 308-2 with--

Signed and Sealed this

Eighth Day of September, 2009

David J. Kappos

David J. Kappos
*Director of the United States Patent and Trademark Office*